United States Patent [19]

Becker, Jr. et al.

[11] 4,196,054

[45] Apr. 1, 1980

[54] ONE-SPOT COKE QUENCHING APPARATUS

[75] Inventors: Joseph Becker, Jr.; Ronald O. McClelland, both of Pittsburgh, Pa.

[73] Assignee: Koppers Company, Inc., Pittsburgh, Pa.

[21] Appl. No.: 846,892

[22] Filed: Oct. 31, 1977

Related U.S. Application Data

[63] Continuation-in-part of Ser. No. 659,337, Feb. 19, 1976, abandoned.

[51] Int. Cl.[2] ..... C10B 39/14

[52] U.S. Cl. ..... 202/227; 202/263

[58] Field of Search ..... 202/227, 262, 263; 201/39

[56] References Cited

U.S. PATENT DOCUMENTS

| | | | |
|---|---|---|---|
| 976,580 | 11/1910 | Krause | 202/227 |
| 1,006,281 | 10/1971 | Ries | 202/227 |
| 2,232,116 | 2/1941 | Koppers | 202/227 |
| 3,868,309 | 2/1975 | Sustarsic et al. | 202/262 |
| 3,869,352 | 3/1975 | Allen et al. | 202/227 |
| 3,959,083 | 5/1976 | Goedde et al. | 201/39 |
| 3,984,289 | 10/1976 | Sustarsic et al. | 202/262 |
| 3,988,211 | 10/1976 | Lewandowski et al. | 202/227 |
| 4,053,068 | 10/1977 | Gidick | 202/262 X |

FOREIGN PATENT DOCUMENTS

| | | | |
|---|---|---|---|
| 201551 | 4/1924 | United Kingdom | 202/227 |
| 1391600 | 4/1975 | United Kingdom | 202/227 |

*Primary Examiner*—Arnold Turk
*Attorney, Agent, or Firm*—R. Lawrence Sahr

[57] ABSTRACT

A one-spot hopper, provided with means for developing layers of coke therein, of even depth, is pivotally mounted to a frame that is movable alongside the coke side of a coke oven battery. Extendible and retractable covers close, and seal the hopper from the ambient atmosphere. A cylinder-piston means is used to pivot the hopper and dump coke therein through pivoted side plates of the hopper. Means are provided to also close off and seal the coke pushing operation of the coke oven battery from the ambient atmosphere. At least one perforated conduit extends transversely through the hopper, and a perforated shield is disposed in spaced-apart relation above the conduit. Means is provided for flowing a cooling fluid in the conduit. A duct is fitted to the hopper to provide a means for extracting gases and entrained particulate matter emanating from hot coke deposited in the hopper.

10 Claims, 3 Drawing Figures

ONE-SPOT COKE QUENCHING APPARATUS

CROSS-REFERENCE TO RELATED APPLICATION

This application is a continuation-in-part of application Ser. No. 659,337, filed Feb. 19, 1976 now abandoned.

BACKGROUND OF THE INVENTION

1. Field of the Invention

The present invention relates generally to a one-spot apparatus for receiving hot coke pushed from a horizontal coke oven chamber and, more particularly, to an improved one-spot coke quenching car.

2. Description of the Prior Art

In the operation of a conventional coke oven battery comprising numerous coking chambers, it is customary to push coke from the chambers on a regular schedule. The hot coke is pushed by a machine carrying a ram that is designed especially for pushing the coke out of the oven chamber and through a coke guide. The coke guide is designed to channel the hot coke into a coke quenching car that is ready the receive the hot coke pushed from the oven chamber.

Heretofore, it has been customary to so place a quenching car that the hot coke gravitates initially into one end portion of the car. Then, as the coke continues to gravitate into the car, the car is moved on rails by a locomotive so that the coke is more or less evenly distributed in the car.

The bottoms of the conventional coke quenching cars are generally sloped away from the coke side of a coke oven battery and toward the coke wharf. Pivotal side gates are positioned in the side of each car on the side adjacent to the coke wharf to facilitate discharge of the coke onto the wharf. Such a car is illustrated in FIG. 1 of U.S. Pat. No. 2,232,116 and the quenching problems inherent in such a design are described therein.

A second style of coke quenching car, not commonly in use, is illustrated in FIG. 2 of U.S. Pat. No. 2,232,116, that being a sloped-bottom, tiltable car. The deficiencies of such a design are likewise described in that patent. A third style of coke quenching car, likewise not commonly in use, is disclosed in FIG. 3 of U.S. Pat. No. 2,232,116. The essence of the disclosure is that a particular angle of slope in the bed of the quench car enhances the even spreading of coke in that car. The invention of U.S. Pat. No. 2,232,116 contemplates, of course, the slow movement of the quench car past the coke guide as the coke is being pushed (see page 1, column 2, lines 12–20).

After the hot coke is deposited in the coke quench car, the car is moved by a locomotive to a remote coke quenching station and water is sprayed onto the hot coke, which quenches it and cools it. After quenching, the coke is dumped onto a coke wharf, and the quenching car returns to the coke oven battery and is ready to receive another load of hot coke from another coke oven chamber.

Recently, environmental considerations have precipitated a search for a means to contain noxious hot gases and particulate matter that emanate from the hot coke both during and after the push. One such method is disclosed by U.S. Pat. No. 3,984,289 wherein a hood, enclosing the push, is combined with a coke quench car, which employs a retractable wire mesh screen, along with a gas cleaning car, which sucks the gases and particulate matter from the coke quench car. In this disclosure, as was previous practice, the coke quench car is towed slowly past the open coke oven door, during the push, to more or less evenly spread the hot coke being deposited. The wire mesh screen follows the movement of the quench car, to cover that portion of the top of the quench car which is not directly below the coke guide. The wire mesh screen is not a seal but, rather, is an open web to allow ambient air to enter the quench car to displace the gases and particulate matter sucked into the gas cleaning car. The bottom of the coke quench car, disclosed in this invention, is the conventional sloped type illustrated in FIG. 1 of U.S. Pat. No. 2,232,116 referred to above.

The system disclosed in U.S. Pat. No. 3,984,289 provided a significant advance in the state of the art as it made it possible to contain the hot gases and particulate matter, emanating from hot coke being pushed in the quench car itself, rather than within a cumbersome shed-like structure built to surround the whole coke side of a coke oven battery. However, the system was not entirely effective as there was no real sealing of the coke quench car. Rather, the system depended on the suction produced by the gas cleaning car to draw off the gases and particulate matter. It was recognized that, practically, it was commercially unfeasible to develop a high temperature moving seal, one that would allow the quench car to be drawn slowly past the coke guide and open coke oven, which could effectively contain emanating gases and particulate matter to the extent required by current governmental regulation. This recognition came after many unsuccessful attempts. Extensive review of the prior art developed no solutions. The technologists, those skilled in the art, publicly admitted, in response to governmental inquiry, that the state of the art did not permit the degree of containment of emanating gases and particulate matter that was mandated by the governmental regulations.

Out of the frustrated state of the art, the question was rhetorically posed: If a moving seal could not be made to work effectively, why not use a stationary seal? But to do so would necessitate stopping the quench car and stationarily positioning it below the coke guide. It was recognized that stationary positioning of a conventional quench car would be unfeasible in that the hopper of such a quench car would not be high enough to contain the full charge of coke gravitated into it from a single oven. The obvious solution was to build a higher hopper. However, due to space limitations, this obvious solution posed problems. The problem of space restrictions existed in a multitude of older coke oven batteries. To utilize a higher car would require extensive expensive and time-consuming modification. Thus, the obvious solution was commercially unfeasible.

Since the concept of moving the coke quench car slowly past a discharging oven had, for its purpose, the even spreading of the coke in the quench car, the thought occurred that perhaps it was feasible to stationarily position the car and, by other mechanical means, spread the discharging coke within that quench car. However, the utilization of mechanical means required the introduction of complicated and expensive hardware not susceptible to withstanding the abrasive conditions inherent in the particulate matter which emanated from the hot coke. Nor could the hardware withstand the heat for a sustained period. Thus, the utilization of such mechanical means was deemed commercially unfeasible.

An additional problem was recognized, in the pursuit of a quench car which was higher, with a deeper hopper. Coke placed in such a quench car was piled deeper. Conventional means of water spray quenching could not penetrate deeply enough into the piled coke to adequately quench it. This resulted in an inferior quality of coke. If the coke were to be evently quenched in a deep quench car, means had to be found to achieve that end.

Further investigation of the quenching problem in a deep hopper revealed that the conventional use of a sloped bottom further deterred the even cooling of the coke as, even if the coke could be evenly spread longitudinally in the quench car, the depth of the coke varied from one side of the quench car to another. Thus, it became incumbent upon those skilled in the art to eliminate the uneven depth of the coke across the width of the coke quench car. The obvious approach was to use a flat-bottomed tilt hopper quench car as similar to that described in U.S. Pat. No. 2,232,116. But the quench cars described therein contemplated swivel points inboard of the wheels. To dump the coke necessitated a lowering of the discharge side of the coke car to a relatively greater degree than could be accommodated by most existing coke wharfs. On the other hand, to move the pivot point outboard of the wheels, utilizing a deep hopper, was seen to cause an imbalance of the overall quench car as the center of gravity of the load shifts in the tilting, a problem not found in the shallow tilt designs shown in U.S. Pat. No. 2,232,116. Thus, to utilize a flat-bottomed tilt hopper, means are required to offset the imbalancing effect of a shift in the center of gravity.

Conventional coke quenching contemplates spreading the hot coke in a relatively thin layer in a quench car and, simply, rapidly inundating the coke with sprayed water. Large amounts of steam, laden with particulate matter and other contaminants, effervesce from the coke. To contain this dirty steam, the quenching is usually accomplished in an enclosed quenching station with equipment to clean the steam. Once the steam is cleaned, part of it condenses and is reused while the balance is exhausted into the atmosphere. The conventional quenching station is usually remote from the coke oven battery, necessitating the transfer of the loaded quench car thereto.

Other methods of coke quenching have been suggested as evidenced by earlier patents. U.S. Pat. No. 1,006,281 discloses apparatus arranged so that coke being discharged from a coke oven gravitates, in a continuous motion, down through a trough, through a chute and onto a conveyor belt for removal. Water spray means are affixed to the uppermost periphery of the trough to spray water onto the moving coke. Spray means are interposed at the juncture of the bottom of the trough and the top of the chute to further quench the coke. To provide adequate spray, the spray means contemplates pipe running through the aperture of the juncture to conduct an even spray over the cross section of the juncture, onto the moving coke. Additional quenching is provided at the conveyor.

Those skilled in the art recognized long ago the basic disadvantage of the invention disclosed in U.S. Pat. No. 1,006,281. Simply put, there was an insufficient time period in which the coke contacted the water coupled with insufficient water contacting the coke. What water contacted the hot coke, blew off as steam without sufficiently and rapidly decreasing the temperature of the hot coke. Thus, an inferior grade of coke was produced.

A recent variation of the quenching method disclosed in U.S. Pat. No. 1,006,281 is found in U.S. Pat. No. 3,988,211. The invention disclosed in this latter patent, again, contemplates spraying water onto continuously moving coke. Spray nozzles are placed variously around the periphery of a vessel through which hot coke is continuously moved. An additional spray means is, more or less, centrally interposed within the quenching vessel to spray water onto the coke as it moves downwardly through the quenching vessel, the object being to obtain a more uniform cooling of the coke. Additional means are also provided to post quench the coke as it is extracted from the quenching vessel, suggesting problems similar to those encountered in implementing the apparatus and cooling method of earlier U.S. Pat. No. 1,006,281.

U.S. Pat. No. 976,580 discloses apparatus which resembles a traveling quenching station. A trough with a sloped bottom is disclosed with means provided to water spray the hot coke immediately upon discharge from a coke oven. A hollow crossbeam is interposed centrally through the trough to subject the core of the coke, through lateral openings, in the crossbeam, to quenching water. The crossbeam serves the additional purpose of breaking up the coke as it passes over the crossbeam, said to enhance the cooling of the coke. The function of the crossbeam is similar to the internal quenching means disclosed in both U.S. Pat. No. 1,006,281 and U.S. Pat. No. 3,988,211, i.e., to spray the hot coke as it moves across the hollow beam as described in Claim 2 of U.S. Pat. No. 976,580. Additional spraying means are provided in the door at the lower end of the trough to spray the hot coke as it leaves the trough, suggesting similar cooling problems to those of U.S. Pat. No. 1,006,281.

The above prior art did not recognize that spraying hot coke to quench it is only effective where that hot coke is spread in very thin layers. Where the coke is piled, heaped or spread in thicker layers, it must be momentarily flooded to achieve a sufficiently rapid decrease in temperature, but that flooding must be limited to allow sufficient heat to remain internally in each particle of coke to drive off residual moisture to achieve a low degree of moisture content in the cooled coke. To spray hot coke for a lengthy period to cool it below critical oxidation temperatures allows the coke to absorb too much water, thus degrading coke quality. To spray hot coke for shorter periods is to allow it to remain at an elevated temperature where undesirable oxidation occurs, again degrading the quality of the coke.

Other methods of quenching have been attempted, notably, dry or gas quenching. An example of a dry or gas quenching method and apparatus is disclosed in British Pat. No. 201,551. As is well known in the art, dry or gas quenching has not proved capable of economically processing sufficiently large quantities of coke to make the process commercially practicable.

SUMMARY OF THE INVENTION

A one-spot hopper is provided with a means for maintaining coke therein at an even depth and is pivotally mounted to a frame that is movable alongside a coke oven battery. The point of pivotation is located on the frame such that the center of gravity of the hopper is not shifted outboard of the transverse points of balance of the frame when the hopper is pivoted. The hopper is arranged so that, at all times, it is, in its entirety, vertically, above the existing heights of conventional coke wharfs. The upper edge of the hopper, which is positioned adjacent the coke side of the coke oven battery in operation, is lower than the elevation of a conventional coke guide. The frame is arranged to accommodate a greater depth of hopper than found in conventional coke quench cars. Extendible and retractable means are provided for covering and sealing, from the ambient atmosphere, the open top of the hopper. Means is provided for pivoting the hopper in a direction away from the coke oven battery. Means is provided within the hopper for fluid flooding the central core of the coke piled therein. Additional means is provided for protecting the water flooding means from the heat and shock of the hot coke gravitating into the hopper and is arranged so as not to hinder the operation of the water flooding means. Means is also provided to conduct a large volume of water rapidly into the central core of the hot coke piled in the hopper, operable when the hopper is positioned at an otherwise conventional quenching station. A pivoted side portion of the hopper allows quenched coke therein to be discharged therefrom onto a conventional coke wharf.

For a further understanding of the invention and for features and advantages thereof, reference may be made to the following description and the drawing which illustrates a preferred embodiment of equipment in accordance with the invention.

DETAILED DESCRIPTION

Figure 1:
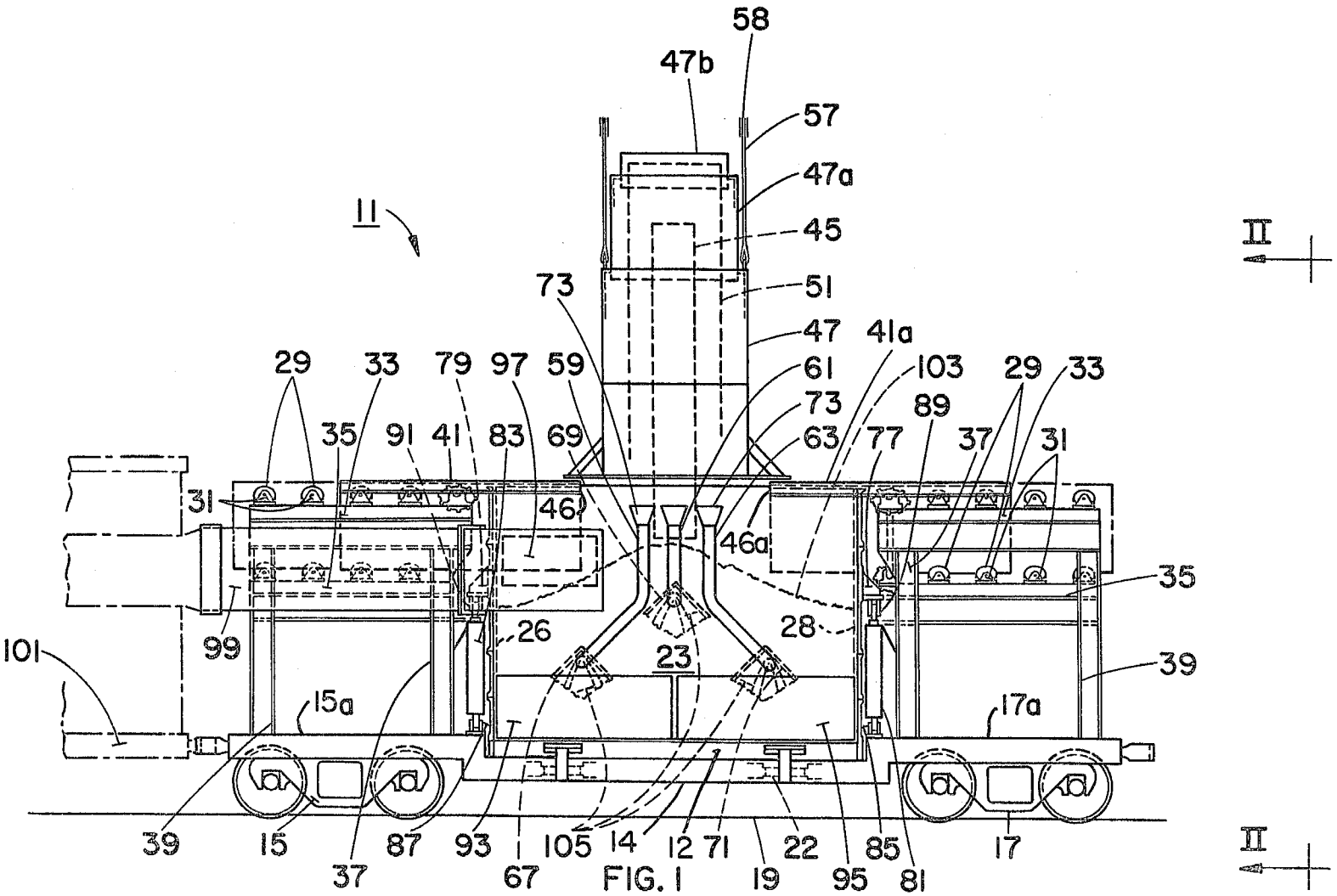
FIG. 1 is a schematic side elevational view of one embodiment of the invention.

Referring to FIG. 1, a one-spot coke quenching car 11 in accordance with the present invention includes a frame 13 supported on conventional front 15 and rear 17 trucks having wheels cooperating with rails 19 extending along the coke side of a coke oven battery 21. The central portion 14 of the frame 13, between the front truck 15 and rear truck 17, is vertically depressed from the end portion 15*a*, 17*a* of the frame which are above the front 15 and rear 17 trucks.

Figure 2:
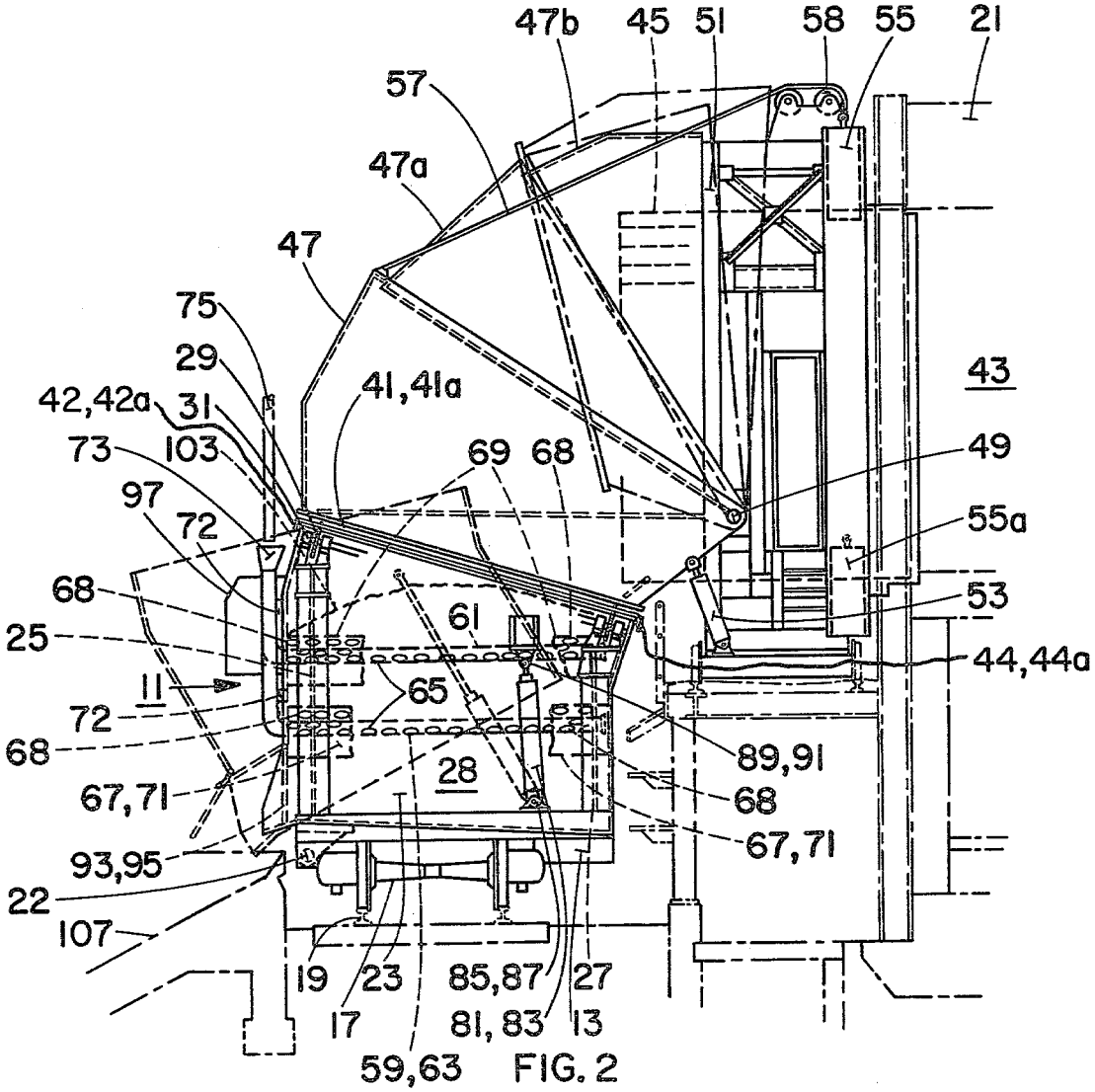
FIG. 2 is an end view, along line II—II, of the apparatus of FIG. 1.

Mounted pivotally as at 22 to the frame 13 is a coke receiving hopper 23 that has substantially four walls and a substantially flat bottom. Two of the walls, side walls 25 and 27, are longitudinal, rectangular and vertical. The cross walls 26 and 28 are vertical and connect the two side walls 25 and 27. Side wall 25 is higher than side wall 27. Cross walls 26 and 28 are trapezoidally shaped such that their upper edges slope downwardly from side wall 25 to side wall 27. The top edges of side walls 25 and 27 and cross walls 26 and 28 form an oblique plane, as shown in FIG. 2, forming an aperture which is the open top of the hopper 23.

The flat bottom 12 is positioned over the central portion of the frame 14. The flat bottom 12 of the hopper 23 is slightly inclined toward the coke side of the coke oven battery 21 when the hopper is disposed in position, as shown in FIG. 1 and bold lines in FIG. 2. The purpose of this inclination is to shift the center of gravity of the hopper 23 toward the coke side of the coke oven battery 21, both when the hopper is loaded and empty, as a safety measure, and also to provide an area for the accumulation of quench water to locate an additional point of origin for the explosive displacement hereinafter described.

Along the tops of the side walls 25 and 27 there are arranged, in spaced-apart relation, a plurality of rollers 29, and each roller is journaled in brackets 31 mounted to the top of the wall.

Extending toward the right, and also extending toward the left, as viewed in FIG. 1, are horizontal structural members 33 and 35, which also carry brackets 31 and rollers 29 journaled therein. The horizontal structural members 33 and 35 are supported by suitable columns 37 and 39 mounted to the frame 13 about as shown.

Two sections of an extendible and retractable cover 41 and 41*a* are disposed on the rollers 29; the one section 41 extending toward the left and the other section 41*a* extending toward the right, as viewed in FIG. 1. The cover sections 41 and 41*a* are slidable on the rollers 29 to the right and to the left, as shown in dotted outline. The cover sections 41 and 41*a* would be positioned at the far left and far right when the coke quenching car 11 is at the quenching station since the entire length of the hopper 23 would then be open when the hot coke is quenched and cooled.

On each of the two sections of extendible and retractable cover 41 and 41*a* there are formed vertical lips 42, 42*a*, 44 and 44*a* positioned to extend downwardly along the upper edges of side walls 25 and 27, as shown in FIG. 2, to assist in sealing the open top of the hopper 23 when the two cover sections 41 and 41*a* are centrally retracted towards each other to cover the open top of the hopper 23.

In operation, the lower surfaces of the covers move slidably in contact with the top edges of the side walls 25 and 27 and the cross walls 26 and 28. The leading edges 46 and 46*a* of the covers 41 and 41*a* act as scrapers to remove any residue and debris that might collect along the top edges of side walls 25 and 27 and/or cross walls 26 and 28, thus enhancing the sealing effected by the central retraction, towards each other, of the two cover sections 41 and 41*a*.

When the coke quenching car 11 is spotted to receive hot coke from a coke oven chamber 43, as suggested in FIG. 2, a coke guide 45 is positioned in front of the oven, as shown, and a hood comprising three sections 47, 47*a* and 47*b* that is pivotally mounted, as at 49, to the coke guide carriage 51, is lowered from its raised position, as shown in phantom outline, by means of a cylinder-piston assembly 53 to closely conform to the sloping top of the hopper 23 and to fit between the two cover sections 41 and 41*a*. As may be noticed from FIG. 2, a counterweight 55 is attached to a wire or chain cable 57 that passes over sheaves 58 and is also attached to the lower section of the hood 47. When the hood 47 is raised to its inoperative position (shown in dotted outline), the counterweight 55 is in the lower position shown in phantom outline, as at 55*a*.

The side wall 25 of the hopper 23 that is farther away from the coke side of the coke oven battery 21 is pierced in three places, as shown in FIG. 1, by conduits 59, 61 and 63. Each conduit extends traversely of the car 11 and is provided with perforations 65 that direct a flood of cooling liquid that flows downwardly in the conduits 59, 61 and 63 along the exterior of the hopper 23 and oven into the central core of the hot coke therein.

Figure 3:
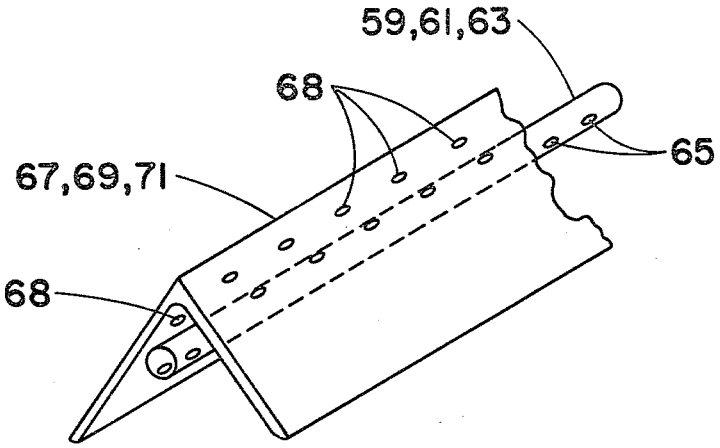
FIG. 3 is a schematic perspective view of a portion of the coke cooling apparatus of FIGS. 1 and 2.

Above each conduit 59, 61 and 63 is a shield in the form of an inverted angle 67, 69 and 71 that is secured to the opposite side walls of the hopper 23. Each angle 67, 69 and 71 has a number of perforations 68 through each leg, as shown in FIG. 3, that allows steam to flow upwardly through the hot coke to cool it; the steam being explosively generated when the flood of cooling fluid (water) contacts the hot coke in the hopper 23 beneath each angle. Of course, other shapes than angles may be used if preferred. The explosive generation of steam serves to level the coke within the hopper 23. The shields 67, 69 and 71 serve to protect the conduits 59, 61 and 63 during the explosive displacement of the hot coke. The conduits 59, 61 and 63 may be supported by suitable hangers from the inverted angles 67, 69 and 71, or in any other suitable manner.

Outside the hopper 23, the conduits 59, 61 and 63, mounted to the wall of the hopper 23 by lugs 72, are disposed vertically, and a funnel 73 is attached to the upper end of each conduit 59, 61 and 63. As shown in FIG. 2, conduits 75, carrying a flood of cooling fluid (water), are disposed conveniently at the quenching station so as to flow cooling fluid into each conduit 59, 61 and 63. Other quenching fluid (water) is sprayed onto the coke in a conventional manner after the coke is explosively displaced by the steam, but while the central core of the coke continues to be flooded.

The hopper 23 is pivotally mounted 22 to the frame 13 at a point beneath the floor 12 but adjacent to the outer side wall 25 of the hopper 23. The hopper 23 is transversely positioned, in relation to the frame 13, such that it is offset toward the coke side of the coke oven battery 21. Side wall 25, being higher than side wall 27 and including thereon conduits 59, 61 and 63, is heavier than side wall 27. Thus, the result of the offset of the hopper 23 is to transversely balance the hopper 23 on the frame 13 such that the center of gravity of the hopper 23 is located between the wheels of the trucks 17 but still located more toward the coke side of the coke oven battery 21 than the transverse center of the trucks 17. In operation, pivotation of the hopper 23 with a full charge of coke shifts the center of gravity of the hopper away from the coke side of the coke oven battery 21, but maintains it between the wheels of the trucks 17.

The hopper 23, being pivotally mounted at 22 to the frame 13, is fitted with supports 77 and 79 at each end of the hopper 23. Fluid-acting cylinder-piston assemblies 81 and 83 are pivoted to the frame 13, as at 85 and 87, and are pivotally connected to lugs 89 and 91 mounted to the supports 77 and 79.

The outer longitudinal wall of the hopper 23 is provided with one or more pivoted lower portions, two such portions 93, 95 being shown in FIG. 1. These pivoted portions 93, 95 are latched closed when the hopper 23 is in the upright position to receive hot coke. But as the hopper starts to pivot at the coke wharf, onto which the quenched and cooled coke is to be dumped, the pivoted portions 93, 95 become unlatched and they swing freely about the axis of their pivots.

The hopper 23 is also fitted with a duct 97 on the outer longitudinal wall 25 that communicates with the interior of the hopper 23, and that connects to a conduit 99 leading to a gas cleaning car 101 coupled to the coke quenching car 11. The gas cleaning car 101, in operation, produces a negative pressure or suction force on the duct 97. When the covers 41 and 41*a* are fully centrally retracted to seal the hopper 23, the hot gases emanating from the coke tend to build up a positive pressure above atmospheric pressure. The negative pressure produced by the gas cleaning car 101 neutralizes the positive pressure to create a gas current flow from the hopper 23, into and through the duct 97, and into the gas cleaning car 101 where the gases are stripped of noxious contaminants, the cleaned gas then being expelled into the ambient atmosphere.

In operation, the coke quenching car 11 is spotted at the coke oven chamber 43 which is to be pushed. The doors (not shown) are removed and the coke guide 45 is positioned to guide the coke cake into the hood 47, which is lowered from its inoperative position; the three sections of the hood 47, 47*a* and 47*b* comprising a zone through which the coke passes into the hopper 23. The covers 41, 41*a* are opened just far enough to accommodate the hood section 47, in the position shown in FIG. 2. The hot coke gravitates into the hopper and fills it to a line 103, about as shown in FIGS. 1 and 2. The shields or inverted angles 67, 69 and 71 prevent the coke from impinging upon and damaging the conduits 59, 61 and 63. During this operation, the hot gases and entrained particulate matter emanating from the hot coke are being conducted from the hopper 23 through the duct 97 and into the gas cleaning car 101.

When the coke oven chamber 43 has been emptied, the hood 47 is activated to rise towards its inoperative position. As the hood 47 is activated to rise, the covers 41 and 41*a* are rapidly retracted to the closed and sealed position with edges 46 and 46*a* abutting centrally over the hopper 23, and the quenching car is transferred to the quenching station.

When the quenching car is at the quenching station, the covers 41 and 41*a* are extended and cooling fluid, usually water, flows in the conduits 75 and 59, 61 and 63 and floods out through the perforations 65 in such conduits. The coke, when it gravitates into the hopper, forms a void 105 beneath each shield or angle, and the cooling fluid flooded from the conduits 59, 61 and 63 impinges on the hot coke as the water explosively flashes into steam. The initial explosive shock of the water flooded onto the hot coke displaces the coke so as to level it in the hopper 23. The steam passes through the apertures in the shields or angles and partially cools the hot coke above the shields or angles. After the hot coke is leveled, water is sprayed onto the top of the coke in the hopper, in a normal manner, to quench the coke. Water continues to be flooded into the central core of the coke through conduits 59, 61 and 63 to uniformly quench the coke.

In some applications, by design, the quenching car structure may be made sufficiently tight so that cooling water drains from the coke at a slow rate, and a pool of cooling water may be maintained initially in the bottom portion of the car. This pool of cooling water assists in thoroughly quenching the bottom portion of the coke mass in the car.

After the coke has been quenched, the car is moved to a coke wharf 107 (shown schematically in FIG. 2). The cylinder-piston assemblies 81 and 83 are then actuated to pivot the hopper about the pivot pins 22. As the hopper pivots, the hinged, pivoted side portions 93, 95 become unlatched and they pivot freely to the open position shown in FIG. 2 in the phantom outline. The quenched coke then gravitates through the openings onto the coke wharf.

After the coke is discharged onto the coke wharf, the hopper is pivoted back to its upright position and the hinged side portions 93 and 95 become latched again. Then, the car is again ready to receive another batch of coke.

From the foregoing description of one embodiment of the invention, those skilled in the art should recognize many important features and advantages of it, among which the following are particularly significant:

That the quenching car is filled at a one-spot position, thus eliminating the need to move it like a conventional quenching car in order to distribute the hot coke more evenly in the quenching car;

That the quenching car of the present invention is shorter in length, whereby it is less costly to construct and to maintain;

That, because the coke quenching car is a one-spot quenching car, a conventional synchronization system between the pusher ram traverse in the oven, and the travel of the quench car is obviated; and That the cover plates over the hopper of the quenching car need to be opened only far enough to admit the hood, and conventional systems requiring folding screens, roller-type curtains or long cover plates for conventional quenching cars that travel are eliminated.

Although the invention has been described herein with a certain degree of particularity, it is understood that the present disclosure has been made only as an example and that the scope of the invention is defined by what is hereinafter claimed.

What is claimed is:

1. Apparatus for receiving and cooling hot coke pushed from a chamber of a coke oven battery comprising:

(a) a frame that is arranged to be movable alongside the coke side of a coke oven;

(b) a hopper into which said hot coke gravitates, while said frame is stationarily positioned, mounted pivotally to said frame and having an open top;

(c) transversal stabilization means, fixed to said frame, upon which movement of said frame is effected and which transversely stabilizes said frame;

(d) pivotation means, mounting said hopper to said frame, arranged to allow pivotation of said hopper while maintaining the center of gravity of said hopper and said hot coke therein inboard of said transversal stabilization means;

(e) extendible and retractable means for covering and sealing said open top and said hot coke in said hopper from the ambient atmosphere, operative to contain hot gases and entrainment emanating from said hot coke;

(f) powered means for pivoting said hopper in a direction away from said battery for discharging said coke therefrom;

(g) means situated internally of said hopper and positioned to be surrounded by said hot coke therein for flooding a cooling fluid into said hot coke to concurrently level and quench said hot coke internally prior to and during the operation of a conventional quenching station;

(h) means for flowing a flood of cooling fluid into said means situated internally of said hopper;

(i) means for discharging said coke from said hopper when said hopper is fully pivoted away from said battery; and (j) exit means by which said hot gases and entrainment are extracted from said hopper to be cleaned prior to entry into the ambient atmosphere.

2. The invention of claim 1 wherein:

(a) said extendible and retractable means includes a plurality of slidable covers coacting with a plurality of rollers, mounted to said frame and to said hopper, slidable along the edges of said open top of said hopper, sealably coacting with said top edges of said open top of said hopper when said hopper is stationarily positioned, to cover said hopper.

3. The invention of claim 1 wherein:

(a) said powered means for pivoting said hopper includes at least one fluid-acting cylinder-piston assembly connected to said frame and said hopper.

4. The invention of claim 1 wherein:

(a) said means situated internally of said hopper includes at least one conduit disposed transversely of said hopper, said conduit having a plurality of perforations therein.

5. The invention of claim 1 wherein:

(a) said pivotation means is further arranged to maintain the lowest portion of said hopper, at all times during operation, above the height of a conventional coke wharf.

6. The invention of claim 1 wherein:

(a) said means for discharging coke includes a portion of said hopper, remote from said coke oven battery, which is pivoted.

7. The invention of claim 4 including:

(a) means, disposed above and in vertical spaced-apart relation to said conduit, for preventing hot coke falling into, or being displaced within said hopper, from impinging on said conduit.

8. The invention of claim 7 wherein:

(a) said means for preventing includes a shield structure that is secured to said hopper, said shield structure having a plurality of perforations therein.

9. Apparatus for receiving and cooling hot coke pushed from a chamber of a coke oven battery comprising:

(a) a frame that is arranged to be movable alongside the coke side of a coke oven battery;

(b) a hopper consisting of two vertical sides, two vertical ends and a substantially horizontal bottom, having an open top, into which said hot coke gravitates, while said frame is stationarily positioned, said hopper being mounted pivotally to said frame, said two vertical sides being unequal in height, the shorter of said vertical sides being positioned adjacent said coke oven battery;

(c) wheeled trucks mounted to the underside of said frame, upon which movement of said frame is effected, the wheels of said trucks being transversely spaced apart such that said frame, said hopper mounted thereto, and said hot coke within said hopper have a combined center of gravity, in all positions of said hopper, which is transversely inboard of said wheels;

(d) at least one pivotal mount, mounting said hopper to said frame, positioned adjacent the juncture of said bottom with the higher of said vertical sides, to allow pivotation of said hopper in a direction away from said coke oven battery and arranged to maintain the lowest point of said hopper, at all times during operation, above the height of a conventional coke wharf;

(e) a plurality of slidable extendible and retractable covers coacting with a plurality of rollers, mounted to said frame and to said hopper, slidable along the edges of said open top of said hopper, sealably coacting with said top edge of said open top of said hopper when stationarily positioned to cover and seal said hopper from the ambient atmosphere, operative to contain hot gases and entrainment emanating from said hot coke;

(f) at least one powered fluid-acting cylinder-piston assembly connected to said frame and said hopper for pivoting said hopper;

(g) at least one conduit, situated internally of said hopper, positioned transversely of said hopper, having a plurality of perforations therein for flooding a cooling fluid into said hot coke to concurrently level and quench said hot coke internally prior to and during the operation of a conventional quenching station;

(h) means for flowing a flood of cooling fluid into said at least one conduit;

(i) at least one pivoted lower portion of said higher of said vertical sides for discharging said coke within said hopper onto a coke wharf when said hopper is pivoted upward; and (j) a duct system, connected to said hopper and to means for cleaning hot gases and entrainment, operable to extract hot gases and entrainment as emitted from said hot coke within said hopper at such time as said hopper is closed and sealed from said ambient atmosphere.

10. The invention of claim 9 further comprising:

(a) shield means disposed above said conduit whereby coke gravitating into said hopper or being displaced therein is prevented from contacting and damaging said conduit.

* * * * *